United States Patent [19]

Osborn

[11] Patent Number: 4,834,698

[45] Date of Patent: May 30, 1989

[54] CAM POSITIONED INDEX TAKE UP ROLL

[75] Inventor: Paul V. Osborn, Webster, N.Y.

[73] Assignee: Mobil Oil Corporation, New York, N.Y.

[21] Appl. No.: 52,302

[22] Filed: May 21, 1987

[51] Int. Cl.[4] ..... B31B 1/10; B65H 20/24

[52] U.S. Cl. ..... 493/193; 493/24; 493/29; 493/225; 226/108; 226/114; 226/117

[58] Field of Search ..... 226/108, 113, 114, 115, 226/117; 493/24, 29, 30, 194, 195, 196, 201, 225

[56] References Cited

U.S. PATENT DOCUMENTS

| | | | |
|---|---|---|---|
| 2,897,729 | 8/1959 | Ashton et al. | 493/196 |
| 3,044,677 | 7/1962 | Miller | 226/117 |
| 3,322,604 | 5/1967 | Schott, Jr. | 83/235 |
| 3,526,563 | 9/1970 | Schott, Jr. | 226/113 |
| 3,722,376 | 3/1973 | Wech | 493/34 |
| 4,256,946 | 11/1982 | Gaskell | 226/117 |
| 4,624,654 | 11/1986 | Boyd et al. | 493/194 |
| 4,702,731 | 10/1987 | Lambrecht et al. | 493/196 |

FOREIGN PATENT DOCUMENTS

| | | | |
|---|---|---|---|
| 128239 | 8/1927 | Switzerland | 226/114 |

OTHER PUBLICATIONS

H. Dunn, "High-Speed Tape Punch", IBM Technical Disclosure Bulletin, vol. 1, No. 1, p. 5, 06 1958.

*Primary Examiner*—Frederick R. Schmidt
*Assistant Examiner*—William E. Terrell
*Attorney, Agent, or Firm*—Alexander J. McKillop; Charles J. Speciale

[57] ABSTRACT

An apparatus and method of handling flexible foldable materials, particularly thermoplastic film webs, continuously fed from a supply by continuously moving input nip rolls to a dancer including a roll mounted for movement transversely to its central axis. Intermittently moving draw rolls intermittently advance material from the dancer roll. The dancer roll is reciprocated in coordination with the intermittent advancement so as to decouple the translational inertia of the dancer roll from the material. A flexible belt also simultaneously rotates the dancer roll so as to decouple rotational inertia of the roll from the length of material. The dancer may be driven by a cam in common with a work station reciprocating against the material fed from the dancer.

6 Claims, 5 Drawing Sheets

CAM POSITIONED INDEX TAKE UP ROLL

This invention is related to my invention disclosed in my patent application entitled, "Driven Idler Indexing System", Ser. No. 052,320 concurrently filed herewith and incorporated herein by reference.

FIELD OF THE INVENTION

This invention relates to plastic film handling apparatus and methods and, in particular, to apparatus and methods for intermittently advancing this plastic film webs for high speed plastic film product manufacture with minimum tension fluctuation.

BACKGROUND OF THE INVENTION

U.S. Pat. No. 4,624,654—Boyd et al, assigned to the assignee of this invention and incorporated by reference, describes a line for manufacturing draw tape bags from a continuous web of thin plastic film. The plastic film web is fed from a supply roll and drawn through an upstream portion of the line, including a first group of work stations, by means of a first pair of input nip rolls which are continuously rotated. The continuous plastic web is intermittently advance away from the nip rolls and through a second group of work stations in a downstream portion of the line by a second pair of intermittently moving nip or draw rolls. The continuous web is accumulated between the input nip rolls and the downstream work stations in a dancer. Several other guide rolls are provided between the dancer and the draw rolls in order to guide the intermittently advanced plastic film web through the downstream portion of the line.

It has been found in operating a bag machine line of the type described in the aforesaid U.S. Pat. No. 4,624,654 at higher cycling speeds, that the inertias associated with the oscillating dancer cause film web bounce and widely varying tension in the film web which affects film tracking, wrinkling and operations such as the tape presealer which is located between the input nips and the draw rolls. These adverse effects resulting from the introduction of varying tension in the film web, limit the maximum speed at which the web can be intermittently advance, and thus the cycling speed of the line.

An object of the present invention is to remove the dancer inertia load from the film web by mechanically coordinating a take up roll position with the bag machine index and hence eliminate the ill affects of web bounce from the operation.

SUMMARY OF THE INVENTION

It is an object of the invention is to reduce tension variations in a continuous length of plastic film fed over a dancer arm supported roller guiding the continuous length of plastic film or other flexible material through at least part of the manufacturing apparatus or process, particularly where the film is intermittently advanced over the dancer arm supported roller, by the provision of a drive which reciprocates the dancer arm with a cyclical movement the dancer arm would normally make were it not cam operated thereby effectively decoupling the translational inertia of the dancer arm from the film. In an embodiment described in connection with a plastic bag manufacturing machine including a pair of draw rollers or the like, which are cyclically actuated for intermittently advancing a continuous length of plastic film over a guide roller supported on a dancer arm, a cam cyclically reciprocates the dancer arm transversely to the central axis of the guide roll in a cycle having a period equal to the period of the draw roll actuation cycle.

According to another feature of the invention, a reciprocating plastic film work station, namely a plastic film heat sealing device, is reciprocated against the film between intermittent advances by the draw rolls. In the described embodiment, the cam and heat sealing device are driven by a common prime mover. However, the cam may be driven in common with the draw rolls.

According to another aspect of the invention, the dancer arm guide roller is also rotated to decouple the torsional inertia of the guide roller from the flexible material. In the described embodiment of the invention, the dancer arm roller is driven with a number of other individual guide rollers by means of an endless flexible coupling, in particular a belt, frictionally engaging with pulleys on each of the rollers. However, the dancer arm guide roller can be independently driven by a stationary flexible coupling as well.

These and other useful and important aspects of the invention will become apparent upon a review of the accompanying figures and following the detailed description of a preferred embodiment.

DETAILED DESCRIPTION OF THE PREFERRED EMBODIMENT

The invention can be incorporated into a bag manufacturing line such as the draw tape bag line described in the aforesaid U.S. Pat. No. 4,624,654 incorporated herein by reference.

Figure 1:
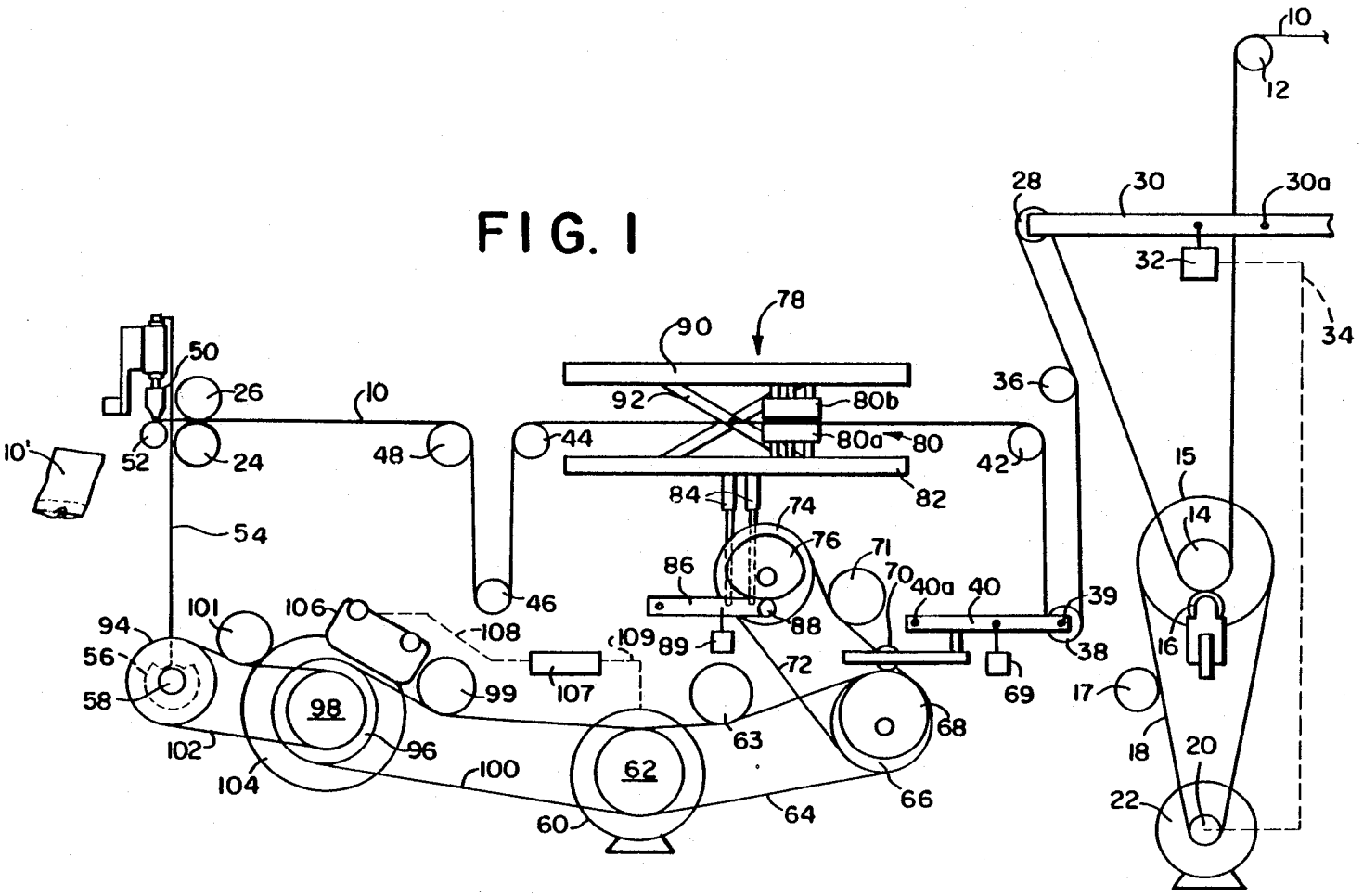
FIG. 1 is a diagrammatic side elevation illustrating the components of a plastic bag making machine incorporating the guide roller drive of the subject invention.

Referring to FIG. 1, a continuous thermoplastic film web 10 is continuously drawn from a supply roll (not shown) over a first idler roll 12 by continuously moving input nip rolls comprising a capstan 14 and pinch roll 16 and fed to a roller 28 supported on one end of a counter weighted dancer arm 30 which is free to rotate about a central shaft 30*a*. The capstan 14 is continuously driven by means of a belt 18 around a pulley portion 15 the capstan 14 and a pulley 20 driven by an electric motor 22. A variable transducer 32 coupled with the arm 30 supplies a varying signal over a suitable channel, indicated by broken line 34, to the capstan motor 22 adjusting the speed of the capstan 14 with movement of the dancer arm 30. The film web 10 continues over a stationary guide roller 36, around idler roller 38 supported on a shaft 39 on a second dancer arm 40 and over stationary guide rollers 42, 44, 46, and 48 to intermittently moving draw rolls 24 and 26. Each of the rolls 36, 42, 44, 46 and 48 and the pivots 30*a* and 40*a* for arms 30 and 40 are supported by stationary frame members omitted from the figures for clarity. The draw rolls 24, 26 intermittently advance one bag width (or length) of film web 10 at a time between a heater/sealer bar 50 reciprocating against an anvil in the form of a roller 52 in a bag machine. The bar 50 seals the trailing side edge of an individual bag body 10' and severs it from the continuous length of film web 10. The bar 50 concurrently seals the leading side edge of the succeeding bag body in the film web 10 and is reciprocated by means of a mechanical linkage represented by a push rod 54 moved by a cam 56 supported on a main shaft 58 beneath the seal bar.

The film contacting portions of each of the idler rolls 36, 38, 42, 44, 46 and 48 is the cylindrical outer surface of a hollow, hard anodized uniform outer diameter aluminum tube. A central axis 39 of roller 38 is specifically indicated in FIG. 1. However, each roller has a central axis parallel to axis 39 about which the film 10 is turned. Friction between the uniform, aluminum cylindrical surface of the rollers and the film is the only means of engagement between the film and these rollers. In the absence of the guide roll drive, the film would have to overcome the rotational inertia of the rollers when the film is accelerated by the draw rolls. This would introduce varying tensions in the film which are unacceptable for high speed bag making operations.

A main motor 60 drives a double pulley 62 connected by a first belt 64 to a second double pulley 66 which is fixed with a cam 68. An air cylinder 69 pulls pivotally supported arm 40 down so that the cam 68 is contacted by a cam follower 70 coupled to the arm 40. A belt 72 couples pulley 66 with a pulley 74 coupled with a cam 76 for operating a presealer 78. The presealer 78 is adapted to preseal the ends of the draw tapes in the bags 10' as hereinafter described. The presealer 78 includes one or more pairs of reciprocated heated metallic jaws 80. The electrical heating connections for the jaws are conventional and omitted for clarity. The jaws 80 can be mounted and actuated in various ways, one of which is shown by way of example. The lower jaw **80*a* is fixed to a lower member 82 which is raised and lowered by a linkage represented by rods 84 coupled to a pivoted arm 86 supporting a cam follower 88. The follower 88 engages the cam 76 and arm 86 is raised by an air cylinder 89. The upper jaw 80*b* is fixed to an upper support member 90 coupled with lower support member 82 through a linkage 92 for cooperation of the lower and upper jaws 80*a* and 80*b***. A stationary frame supporting the illustrated elements is omitted from the figures for clarity.

The presealer assembly 78 forms a heat seal at regularly intervals along the film web 10 where the web will be subsequently contacted by the heated sealer/cutter bar 50. The bar 50, as previously described is operated to heat seal only a very narrow transverse strip forming a side edge of each produced plastic bag 10'. The presealer 78 forms a heat seal in the hemmed region of the web 10 containing more than two layers of thermoplastic film, such as the hemmed region of a draw tape bag containing six or more layers of thermoplastic film, including the ends of the draw tapes.

The pulley 62 is also coupled to a pulley 94 on main shaft 58 through coaxial pulleys 96, 98 and belts 100, 102. Coaxially supported with coaxial pulleys 96 and 98 is a brake disc 104. A brake pad assembly 106 is also supported by the stationary frame (not shown) for engagement with brake disc 104. The brake formed by disc 104 and pad assembly 106 is used to stop the coaxial pulleys 96, 98 as well as the other pulleys 94, 62, 66 and 74 coupled to those pulleys 96 and 98. The motor 60 and brake 104/106 are linked with a common controller, indicated diagrammatically by block 107, by suitable connection means, indicated diagrammatically by broken lines 108 and 109. The motor 60 runs continuously when the bag machine is running. When the motor 60 is on the brake 104/106 is off and vice versa. The brake provides for a fast stop and prevents static machine loads from moving the stopped position to a different point in the cycle. This is important for cycle timing setup. The movable pulleys 17, 63, 71, 99, and 101, are provided for tensioning the belts 18, 64, 72, 100 and 102, respectively.

The various elements 24, 26, 50, 52, 54, 56, 58, 60, 62, 94, 96, 98, 99, 100, 101, 102, 104, 106–109 are all conventional and may be found in such devices as the Amplas Model No. 1402 bag machine.

Figure 2:
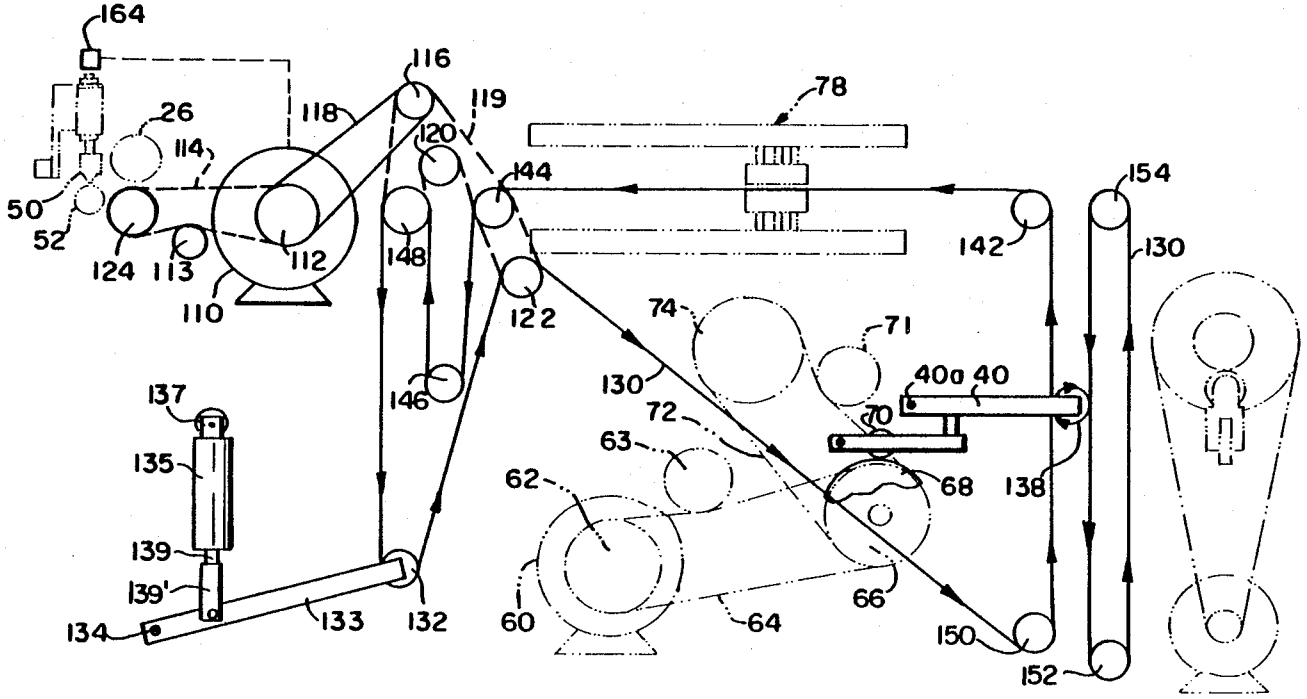
FIG. 2 is a diagrammatic side elevation of a drive belt and pulley system linking the driven guide rolls of FIG. 1 with one another.

Referring now to FIG. 2, there is illustrated the pulley and belt system employed to simultaneously drive each of the guide rolls 38, 42, 44, 46, and 48, FIG. 1, at a surface circumferential speed identical to the speed of the film web 10 intermittently advanced by the nip rolls 24 and 26 from the capstan 14 and pinch roll 16.

Figure 3:
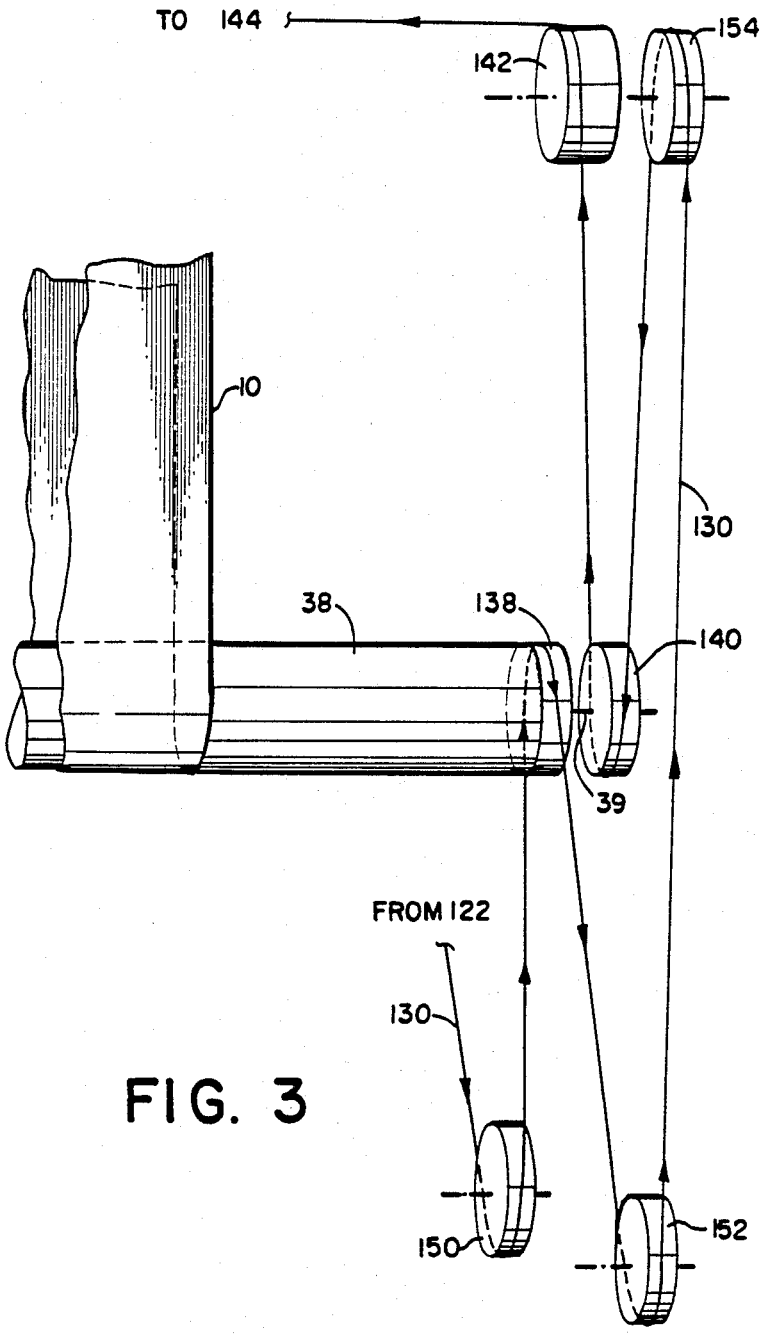
FIG. 3 is a perspective, partially exploded view showing the relation of the dancer arm supported guide roller and pulleys supporting an endless drive belt from the right-hand end of FIG. 2.

A motor 110, FIG. 2, supports and drives a double pulley 112. The motor 110 is a servo drive which goes through precise single movement when triggered. In a single cycle the motor 110 accelerates the draw rolls 24, 26, and the guide rolls at **5*g* to a constant velocity (900 ft./min.) and at the time necessary for a precise index length, for example 30", decelerates the draw rolls and the guide rolls to stop. A pulley 124, coaxial with and fixed to the draw roller 24 of FIG. 1, is driven by pulley 112 through a continuous belt 114. The continuous belt 114 is indicated with broken lines for clarity. A jackshaft supported double pulley 116 is also driven by motor 110 by an endless flexible belt 118 around pulleys 112 and 116. The jackshaft double pulley 116 is supported on one side of the bag machine line by a stationery frame member which has been omitted from the figures for clarity. The jackshaft double pulley 116 in turn drives another endless flexible belt 119 which passes from pulley 116 around a double pulley 148, coaxial to and joined with the guide roll 48 (FIG. 1), around a take-up pulley 120, also supported from the one side of the frame, around a double pulley 122 also supported on the one side of the frame, and back around pulley 116. The various other stationary guide rolls 42, 44 and 46 of FIG. 1 are commonly driven from double pulleys 122 and 148 by a continuous flexible belt 130 passing over the double pulley 148 and around a take-up pulley 132 to double pulley 122. The pulley 132 is supported by an arm 133 pivotally mounted at pivot 134 to a frame member (not shown) and loaded by an air cylinder 135, in turn pivotally mounted to a stationary frame member (not shown) by a clevis 137. The cylinder 135 is pivotally connected to the arm 133 by a clevis 139' on a piston arm 139. The endless belt 130 is also used to drive guide roll 38 on dancer arm 40. This is best seen in FIG. 3. After passing over pulley 122, belt 130 passes around a stationary pulley 150, over a first pulley 138 coaxial with and fixed to dancer roll 38 on shaft 39, down and around a stationary pulley 152, over another stationary pulley 154, down and around a second, freewheeling pulley 140 coaxially mounted on shaft 39 with the dancer roll 38 on arm 40 and over a width of double width pulley 142 coaxial with and fixed to guide roll 42. Since the pulleys 138 and 140 turn in the same direction and at the same speed, i.e. film speed, they may comprise a common double pulley. Referring back to FIG. 2, from pulley 142 the belt 130 continues over pulleys 144 and 146 coaxial with and joined to guide rollers 44, 46, respectively, FIG. 1, and back to pulley 148**.

The servo motor 110 is synchronized with the operation of the motor 60 and when triggered is operated for a fixed period of time sufficient to index a bag width (or length) of the continuous length of film web between the bar 50 and roller 52. The motor 110 is triggered by a the switch 164, FIG. 2, electrically connected thereto and activated by the cam 56 on the main cam shaft 58, FIG. 1. The index is started just after the heated sealer/-cutter bar 50 and the jaws 80 of the presealer 78 retract from the film 10.

For driving rolls approximately 2½ inches in diameter in the indicated configuration, a belt 130 of approximately 260 inches in length was used. The belt 130 was designed to be accelerated and decelerated at 5 G's between speeds of 0 and 930 feet per minute at a rate of 120 cycles per minute. At maximum acceleration and deceleration, tension in the belt can reach as much as 100 lbs., while nominal tension is about 10 lbs. The belt may be endless woven polyester or aramid fibre with a polyurethene coating.

While belts and pulleys have been employed, it is to be understood that other equivalent conventional endless flexible couplings or linkages may be used such as a chain and sprocket, or pulley with a cable, rope or wire.

While the guide roll 38 on dancer arm 40 can be driven in syncronization with other guide rolls, one of ordinary skill in the art will appreciate that the continuous endless belt 130 can be replaced by a flexible coupling member fixed between the pulley positions 142 and 150, FIGS. 2 and 3, but otherwise passing over pulleys 138, 140, 152 and 154 in the manner indicated to rotate the guide roll 38 decoupling its rotational inertia from the film web 10. Of course, the cam 68 would have to be reconfigured to move the arm 40 upwardly in conjunction with such a fixed flexible member so as to decouple both the translational inertia of the guide roll 38 and arm 40 and rotational inertia of the roll 38 from the plastic film.

Figure 4:
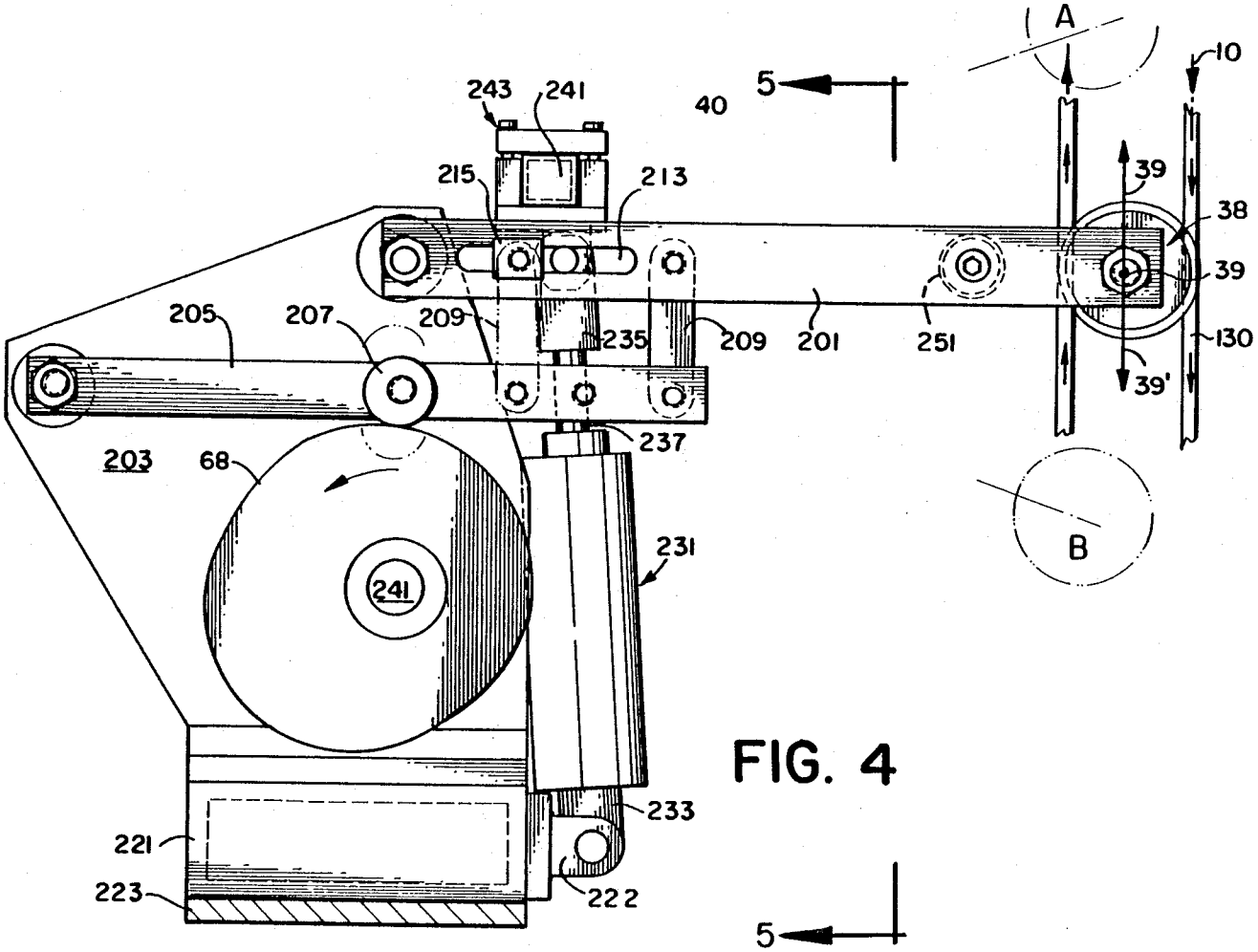
FIG. 4 is a detailed side elevation view of the dancer and driving cam.
Figure 5:
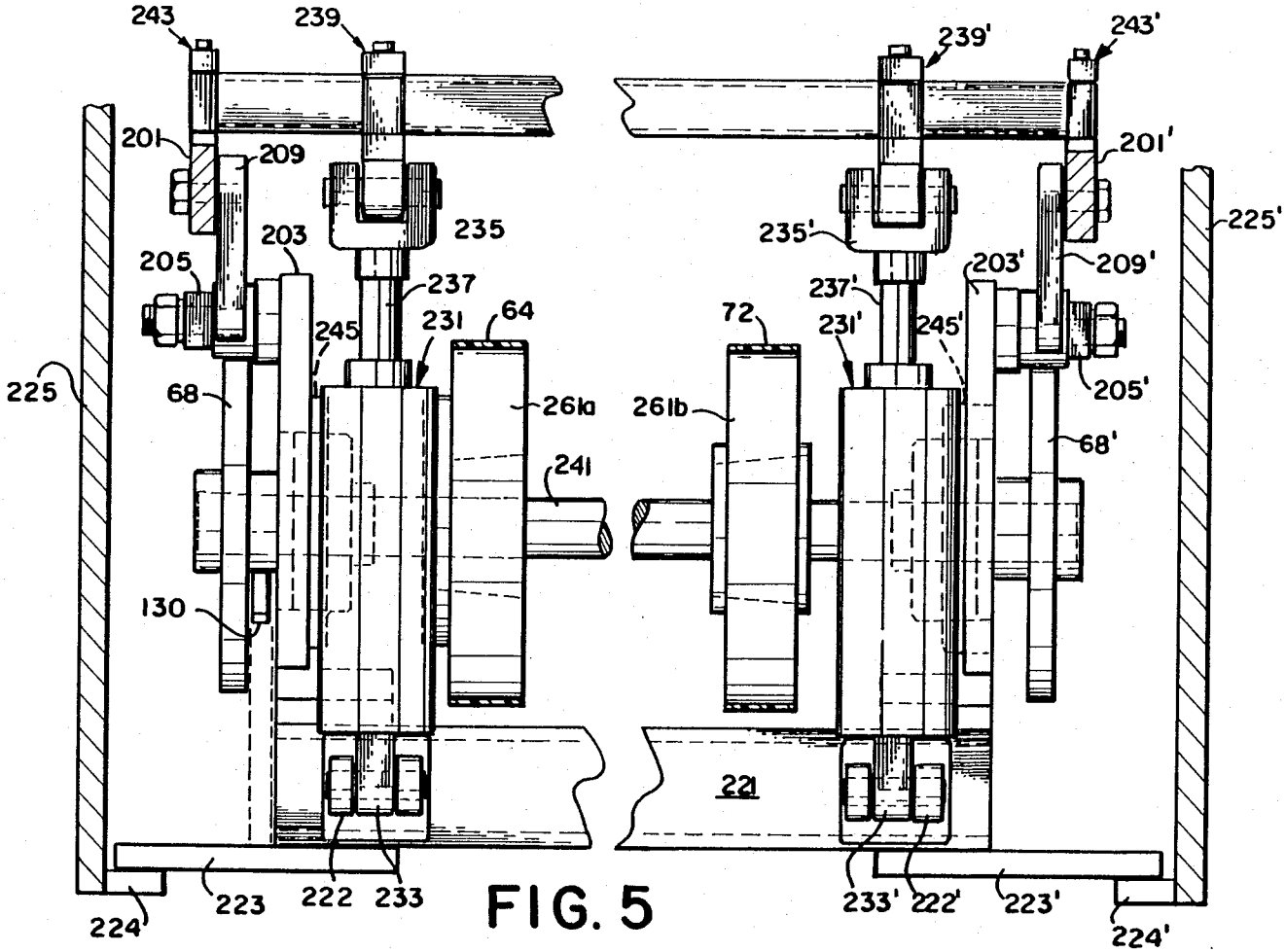
FIG. 5 is a side elevation view orthogonal to FIG. 4 along lines 5—5 of FIG. 4.

FIGS. 4 and 5 illustrate in detail the construction of the cam driven dancer arm 40. As can be seen from these figures, the arm 40 is actually, in the preferred embodiment, an assembly. FIG. 4 shows the elements of one side of the assembly on one side of the machine and the continuous length of plastic film 10 is advanced through the machine. As indicated in FIG. 5, a symmetric set of elements are mounted on the other side of the machine and other side of the continuous length of plastic film. The symmetric elements on either side of the length of plastic film are indicated by identical numbers with the addition of a prime. Referring to FIG. 4, the dancer 40 includes an upper arm 201 rotatably supporting the guide roller 38 at one end thereof for rotation about its central axis 39. The arm 201 is rotatably mounted to a mounting plate 203 at the other end thereof for cyclical translational movement of guide roller 38 in either of two opposing directions 39, 39' from an extreme upper position A to an extreme lower position B, while web 10 is being stored then to the raised position A, while tape 10 is being fed to the draw rolls 24, 26 (FIG. 1). A second lower arm 205 is also rotatably mounted at one end to the mounting plate 203 and carries a cam follower 207. The arms 201 and 205 are linked to one another by a link 209 rotatably mounted at either end to the first two members 201 and 205. The upper end of link 209 may be fixed to arm 201 or it may be moved to the alternate position shown in phantom lines and fixedly mounted along an elongated slot 213 in upper arm 201 by a bracket 215. The position of the member 209 along the slot 213 determines the magnification of the stroke of arm 201. The components can be sized and spaced to magnify a one inch cam follower stroke into a 4.5 to 8.5 inch idler roll stroke by proper positioning of link 209. The plate member 203 is attached by bolts or other suitable means to a hollow rectangular member 221 extending most of the width of the machine. Mounted to the lower surface of the member 221 is an elongated support plate member 223. As seen in FIG. 5, member 223 is fixed to a flange 224 extending from a vertical side plate member 225 forming part of the framework of the machine supporting the various rolls 36, 42, 44, 46 and 48. An air cylinder 231 is pivotally joined to the rectangular support member 221 by means of a flange end 233 received in a clevis 222 extending from the rectangular support member 221. A clevis 235 attached to the piston 237 of the air cylinder 231 is rotatably mounted to a bracket 239, FIG. 5, fixed to a square cross member 241. The member 241 is bolted to the top of upper horizontal arm 201 by a bracket 243 and its counterpart arm 201' by an identical bracket 243' (see FIG. 5). The air cylinder 231 maintains a downward force on the cross member 241 forcing the arms 201 and 205 down and the cam follower 207 against the surface of the cam 68, FIG. 4. The horizontal support arm 201 is also linked to its symmetric counterpart 201' (see FIG. 5) through the supported guide roll 38, FIG. 4. and through a tubular bracing member 251 extending between the arms 201, 201'.

Referring specifically to FIG. 5, the double pulley 66 of FIG. 1 is formed by two single pulleys 261a and 261b fixed to a main shaft 241 supported in journal bearings 245, 245' mounted in support plates 203, 203', respectively. The pulley 261a receives belt 64 from pulley 62 of the main drive motor 60. The pulley 261*b* receives the belt 72 coupling that pulley with the pulley 74 of the presealer assembly 78 (see FIG. 1). The belt 130 driving the roller 38 is passed between support plate 203 and cam 68 FIG. 5.

The extreme raised and lowered end positions of the guide roller 38 are indicated at positions in A and B, respectively, in FIG. 4.

Although a preferred embodiment of the invention has been described and illustrated, it will be understood that other modifications thereto may be made without departing from the spirit and scope of the invention as set forth in the appended claims. Therefore, the subject invention is not limited to the described embodiment but is set forth in the appended claims.

What is claimed is:

1. An apparatus for handling a continuous length of flexible material comprising:

means for continuously supplying a continuous length of flexible material;

guide roll means for turning a continuous length of flexible material continuously supplied form the supply means about a central axis of the guide roll means;

dancer arm means supporting said guide roll means for movement transversely to said central axis;

means for intermittently drawing a continuous length of flexible material from said supply means around said guide roll mans;

drive means coupled with the dancer arm means and moving said dancer arm transversely to said central axis for decoupling translational inertia of said dancer arm means and said guide roll means from the flexible material;

means for coordinating operation of said intermittent drawing means with operation of said drive means;

pulley means coaxially supported with said guide roll means on said dancer arm means for rotation with said guide roll means said pulley means comprising a pair of pulleys;

a first turning device and a second turning device stationarily positioned and spaced from each other and on opposite sides of the guide roll means; and flexible coupling means extending around one of said pulleys in said pair of pulleys, then around the first and second turning devices and back around the other pulley of said pair of pulleys for rotating the guide roll means during movement of the dancer arm means.

2. The apparatus of claim 1 wherein said drive means comprises:

cam means for reciprocating said dancer arm means.

3. A plastic film bag forming machine comprising:

supply means for continuously supplying a continuous web of thermoplastic film;

reciprocating bag forming means for reciprocating against the continuous web of thermoplastic film and forming individual plastic bag bodies;

advancing means for intermittently advancing a predetermined length of the continuous web of thermoplastic film corresponding to a longitudinal dimension of the bag bodies from the supply means to the reciprocating bag forming means;

dancer means between said supply means and said reciprocating means for storing a portion of the continuous web of thermoplastic film between the supply means and the reciprocating bag forming means, said dancer means comprising a pivotal arm, a guide roller mounted for rotation at one end of the arm for engaging the web and a cam follower connected with said arm;

pulley means coaxially supported with said guide roller on said arm for rotation with said guide roller, said pulley means comprising a pair of pulleys;

a first turning device and a second turning device stationarily positioned and spaced from each other and on opposite sides of said guide roller;

driver means coupled to said dancer means for reciprocating said dancer means, said driver means comprising a prime mover and linkage means including a cam driven by said prime mover and engaging said cam follower for coupling the prime mover with the dancer means for reciprocating the dancer means;

second linkage means coupling said prime mover with said reciprocating bag forming means for reciprocating said reciprocating bag forming means;

flexible coupling means extending around one of said pulleys in said pair of pulleys, then around the first and second turning devices and back around the other pulley of said pair of pulleys for rotating said guide roller with reciprocation of said pivotal arm by said cam; and control means coupling said advancing means with said driver means for synchronizing intermittent operation of said advancing means with a cycle of said driver means.

4. A plastic film bag forming machine according to claim 3 wherein said advancing means comprises a servo motor synchronized with the operation of said prime mover.

5. A plastic film bag forming machine according to claim 4 wherein said servo motor is actuated by said control means and operated for a fixed period of time sufficient to index a predetermined length of the continuous web of thermoplastic film corresponding to a longitudinal dimension of the bag bodies to the reciprocating bag forming means.

6. A plastic film bag forming machine according to claim 3 including reciprocating heat sealing means positioned between said dancer means and said advancing means and coupled with said prime mover for heat sealing a portion of the continuous web of thermoplastic film during intermittent cycles of said advancing means.

* * * * *